US011428066B2

(12) United States Patent
Andersen

(10) Patent No.: US 11,428,066 B2
(45) Date of Patent: Aug. 30, 2022

(54) DOWNHOLE WIRELINE INTERVENTION TOOL

(71) Applicant: Welltec Oilfield Solutions AG, Zug (CH)

(72) Inventor: Tomas Sune Andersen, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 348 days.

(21) Appl. No.: 16/256,214

(22) Filed: Jan. 24, 2019

(65) Prior Publication Data

US 2019/0226299 A1 Jul. 25, 2019

(30) Foreign Application Priority Data

Jan. 25, 2018 (EP) ..... 18153490

(51) Int. Cl.
*E21B 33/127* (2006.01)
*E21B 43/26* (2006.01)

(52) U.S. Cl.
CPC ..... *E21B 33/1275* (2013.01); *E21B 43/26* (2013.01)

(58) Field of Classification Search
CPC ..... E21B 33/1274; E21B 43/26
See application file for complete search history.

(56) References Cited

U.S. PATENT DOCUMENTS 2,856,006 A * 10/1958 Buck ..... E21B 47/10 277/333
3,326,293 A * 6/1967 Skipper ..... E21B 29/10 166/150
3,389,752 A * 6/1968 Lebourg ..... E21B 43/116 166/285

(Continued)

FOREIGN PATENT DOCUMENTS

EP 2 960 427 12/2015
RU 2 384 692 C2 3/2010

OTHER PUBLICATIONS

Extended Search Report for EP18153490.0 dated Jul. 18, 2018, 6 pages.

(Continued)

*Primary Examiner* — Robert E Fuller
(74) *Attorney, Agent, or Firm* — Nixon & Vanderhye P.C.

(57) ABSTRACT

The present invention relates to a downhole wireline intervention tool for performing intervention in a well, comprising a wireline, a motor powered by the wireline, a positive displacement pump driven directly or indirectly by the motor for delivering a flow of fluid, an expandable bladder expanded by fluid delivered by the positive displacement pump, and a flow control device comprising an inlet, a piston and a venting port fluidly connected to the well, the piston being movable between a first position in which the venting port is fluidly connected to the expandable bladder and a second position in which the venting port is fluidly isolated from the expandable bladder for expanding the expandable (Continued)

Figure 1A:
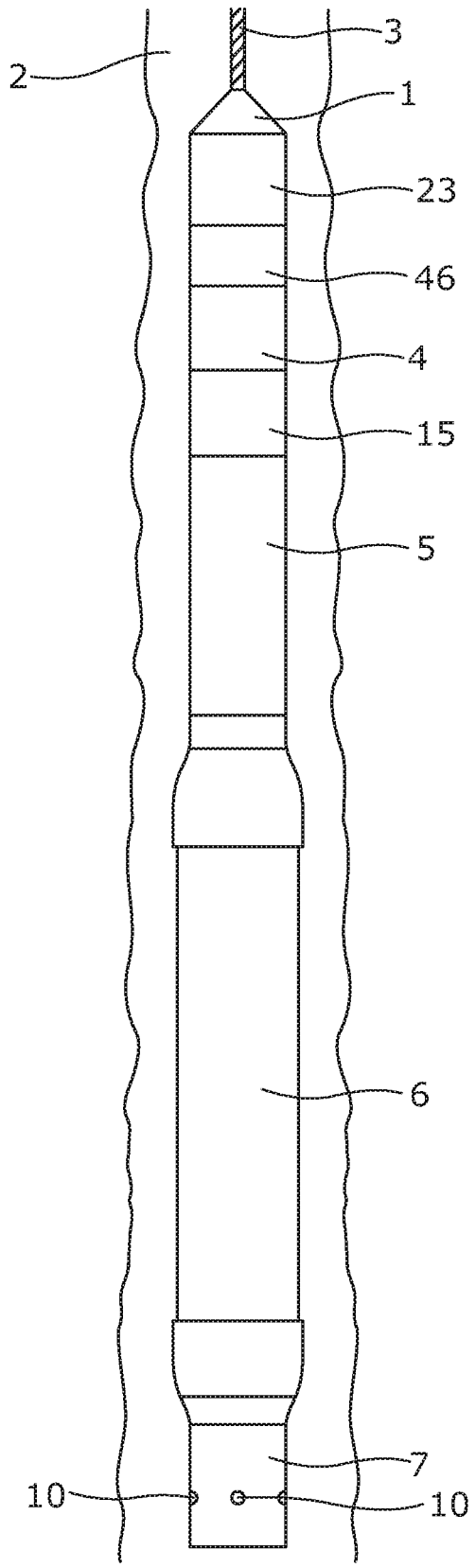

bladder. The present invention also relates to a downhole system comprising a well tubular metal structure, an intervention method for intervening a well by means of the downhole wireline intervention tool according to the present invention and finally, the use of the downhole wireline intervention tool according to the present invention.

19 Claims, 7 Drawing Sheets

(56) References Cited

U.S. PATENT DOCUMENTS 3,456,725 A * 7/1969 Hatch ..... E21B 33/14 166/147
3,460,625 A * 8/1969 Ellis ..... E21B 23/06 166/285
3,650,325 A * 3/1972 Owens ..... E21B 33/134 166/182
5,297,634 A * 3/1994 Loughlin ..... E21B 23/04 166/183
5,404,946 A * 4/1995 Hess ..... E21B 33/1275 166/187
5,785,120 A * 7/1998 Smalley ..... E21B 17/02 166/55
5,833,001 A * 11/1998 Song ..... E21B 43/105 166/287
6,142,230 A * 11/2000 Smalley ..... E21B 17/08 166/277
7,392,851 B2 7/2008 Brennan, III et al.
8,776,899 B2 * 7/2014 Fripp ..... E21B 43/08 166/386
8,955,606 B2 * 2/2015 O'Malley ..... E21B 43/103 166/386
9,447,651 B2 * 9/2016 Hallundbæk ..... E21B 29/10
2002/0157867 A1 * 10/2002 Moore ..... E21B 49/06 175/20
2003/0196795 A1 * 10/2003 Kutac ..... E21B 33/127 166/187
2006/0042801 A1 * 3/2006 Hackworth ..... E21B 33/13 166/387
2007/0095532 A1 * 5/2007 Head ..... E21B 41/0042 166/277
2009/0255691 A1 * 10/2009 Loughlin ..... E21B 33/127 166/387
2009/0283279 A1 * 11/2009 Patel ..... E21B 33/129 166/382
2012/0261127 A1 * 10/2012 Zhou ..... E21B 33/146 166/289
2013/0068528 A1 * 3/2013 Gray ..... E21B 49/008 175/57
2015/0285031 A1 * 10/2015 Kenison ..... E21B 34/14 166/373
2016/0061010 A1 * 3/2016 Sears ..... E21B 33/1275 166/373
2017/0145784 A1 * 5/2017 Zhou ..... E21B 33/1285
2017/0306714 A1 * 10/2017 Haugland ..... E21B 33/1275

OTHER PUBLICATIONS

Office Action dated May 4, 2022 issued in Russian Application No. 2020126863/03(047242) with English translation (18 pages).

* cited by examiner

DOWNHOLE WIRELINE INTERVENTION TOOL

This application claims priority to EP Patent Application No. 18153490.0 filed Jan. 25, 2018, the entire contents of which are hereby incorporated by reference.

The present invention relates to a downhole wireline intervention tool for performing intervention in a well. The present invention also relates to a downhole system and an intervention method for intervening a well by means of the downhole wireline intervention tool according to the present invention. Finally, the invention relates to the use of the downhole wireline intervention tool according to the present invention.

When operating in a well several kilometres from the well head or the blowout preventer, a lot of power is lost through the wireline, and therefore providing enough pressure to expand a patch several kilometres down the well is impossible when using the known wireline tools. Known patch setting tools are therefore operated with pressure from surface via a coiled tubing or a drill pipe in order to provide enough pressure. However, such coiled tubing equipment takes approximately 14 days to transport to an offshore well.

It is an object of the present invention to wholly or partly overcome the above disadvantages and drawbacks of the prior art. More specifically, it is an object to provide an improved intervention tool capable of operating by a wireline capable of expanding a patch several kilometres down a well.

The above objects, together with numerous other objects, advantages and features, which will become evident from the below description, are accomplished by a solution in accordance with the present invention by a downhole wireline intervention tool for performing intervention in a well, comprising:

- a wireline,
- a motor powered by the wireline,
- a positive displacement pump driven directly or indirectly by the motor for delivering a flow of fluid,
- an expandable bladder expanded by fluid delivered by the positive displacement pump, and
- a flow control device comprising an inlet, a piston and a venting port fluidly connected to the well, the piston being movable between a first position in which the venting port is fluidly connected to the expandable bladder and a second position in which the venting port is fluidly isolated from the expandable bladder for expanding the expandable bladder.

The positive displacement pump may be a high pressure pump.

Further, the positive displacement pump may be configured to increase the pressure with more than 300 bar, preferably more than 500 bar.

Moreover, the flow control device may be arranged downstream of the positive displacement pump and upstream of the expandable bladder in order that the inlet is fluidly connected to the positive displacement pump and an outlet is fluidly connected to the expandable bladder.

Also, the flow control device may be arranged between the expandable bladder and the positive displacement pump.

In addition, the piston may comprise a through-bore fluidly connecting the inlet and the outlet.

The flow control device may comprise a chamber in which the piston is movable between the first position and the second position.

Moreover, the flow control device may further comprise a spring configured to force the piston towards the inlet.

Additionally, the piston may comprise a restriction decreasing an inner diameter of the through-bore, creating a pressure drop over the piston.

The downhole wireline intervention tool may further comprise a hydraulic pump driven by the motor for driving the positive displacement pump.

Furthermore, the positive displacement pump may be a reciprocating positive displacement pump, such as a piston pump or a diaphragm pump.

Also, the positive displacement pump may comprise a reciprocating piston and the hydraulic pump may drive the reciprocating piston.

Moreover, a second hydraulic control line may be connected to the hydraulic pump and the flow control device for moving the piston from the second position to the first position.

In addition, the piston may comprise a first sealing element and a second sealing element which in the second position of the piston are arranged in such a manner that the first sealing element is arranged on one side of the venting port and the second sealing element is arranged on the other side of the venting port.

The flow control device may comprise a first part and a second part, the first part comprising the inlet, the venting port and the piston, and the second part comprising the outlet and a second venting port, the first part and the second part being fixated to each other by means of breakable parts, such as shear pins or shear discs, until a predetermined force is reached and the breakable parts break and the first part is movable away from the second part in order to unblock a fluid communication between the second venting port and the expandable bladder.

Further, the flow control device may comprise a breakable element, such as a shear pin or a shear disc, arranged for fixating the piston until a predetermined pressure is reached in the expandable bladder.

The downhole wireline intervention tool may further comprise a control unit for controlling the function of the tool.

Also, the expandable bladder may be arranged around a base pipe.

The base pipe may have an opening.

Furthermore, the expandable bladder may be made of a deflatable material, such as rubber, elastomer etc.

Moreover, the expandable bladder may be made of a reinforced material.

The downhole wireline intervention tool may further comprise a second expandable bladder.

Also, the venting port may comprise a filter.

In addition, the downhole wireline intervention tool may further comprise a driving unit, such as a downhole tractor.

The present invention also relates to a downhole system comprising a well tubular metal structure arranged at least partly in a borehole of a well and further comprising a downhole wireline intervention tool as described above.

The downhole system, as described above, may further comprise a patch configured to be expanded by the expandable bladder at a certain position in the well.

The present invention also relates to an intervention method for intervening a well by means of the downhole wireline intervention tool as described above, comprising:

- intervening the well by means of the downhole wireline intervention tool,
- positioning the downhole wireline intervention tool at a certain position in the well,
- activating the positive displacement pump for delivering a flow of fluid into the expandable bladder, expanding the expandable bladder when the piston of the flow control device is in the first position, moving the piston of the flow control device from the first position to the second position, and deflating the expandable bladder by activating the flow control device.

Also, the moving of the piston of the flow control device from the first position to the second position may be performed by breaking a breakable element when reaching a predetermined pressure difference, releasing the piston, or by stopping the flow of fluid from the positive displacement pump equalising the pressure in order that the piston is free to move.

Finally, the present invention also relates to use of the downhole wireline intervention tool for fracturing a formation downhole in a well, setting of a patch, isolating a part of the well, or expanding an annular barrier.

Figure 1B:
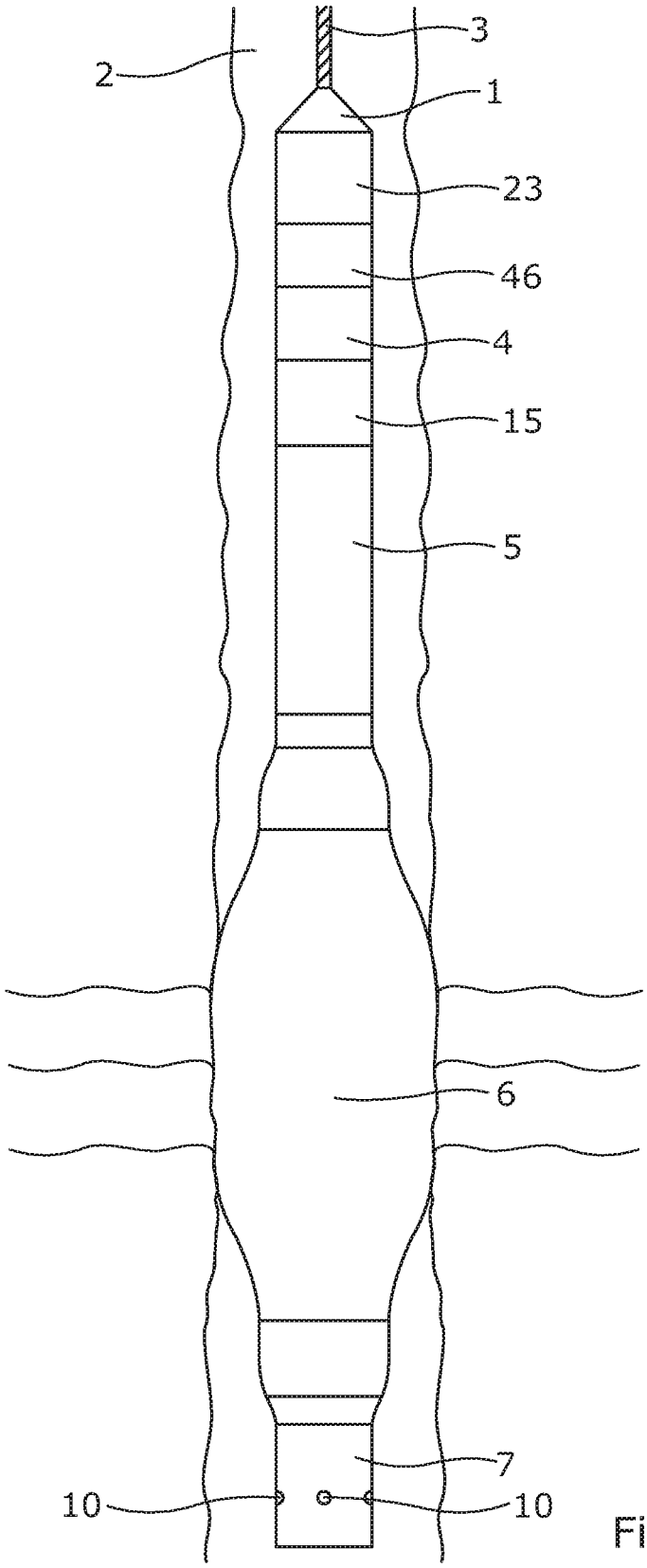
Figure 2A:
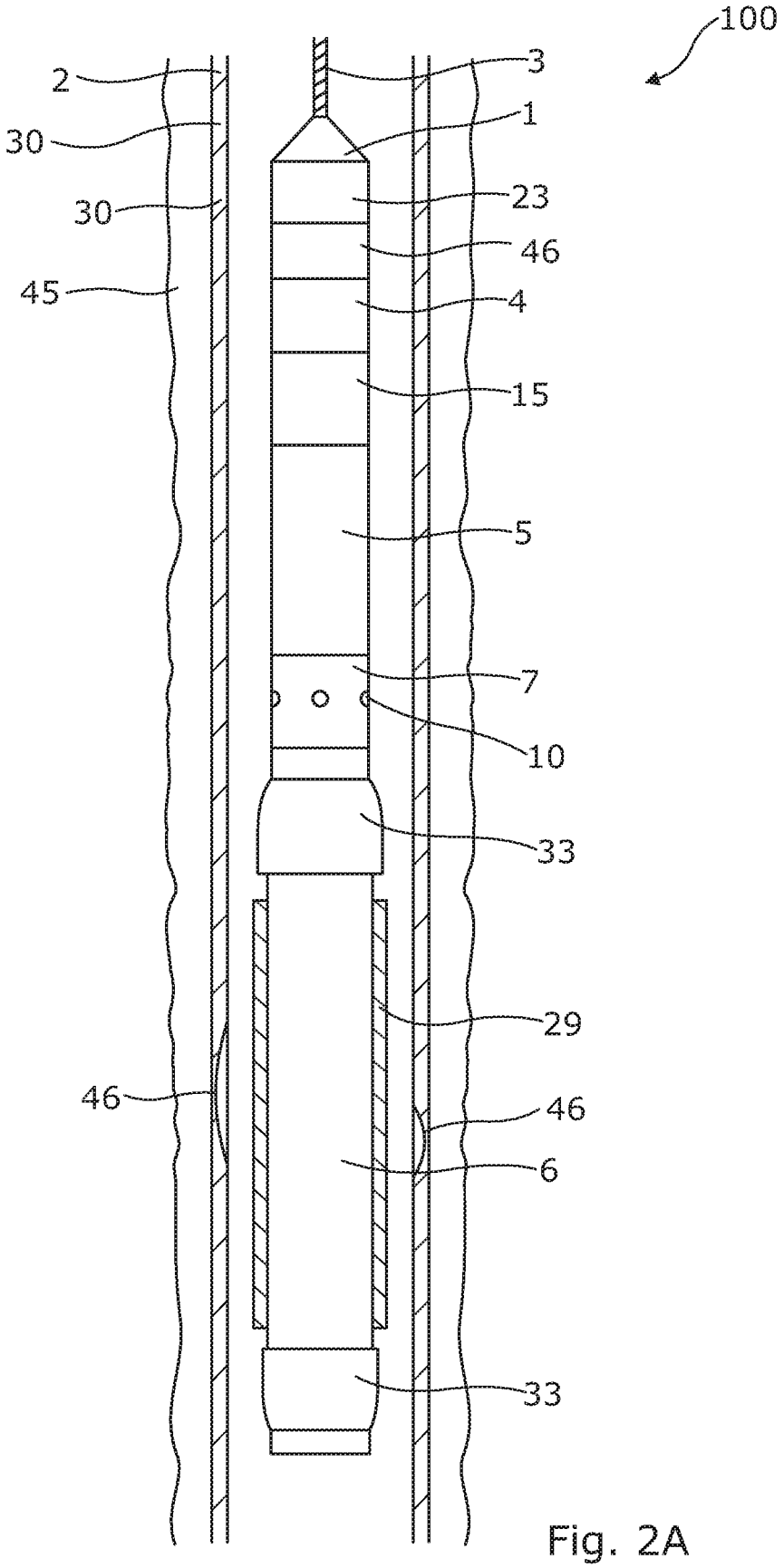
Figure 2B:
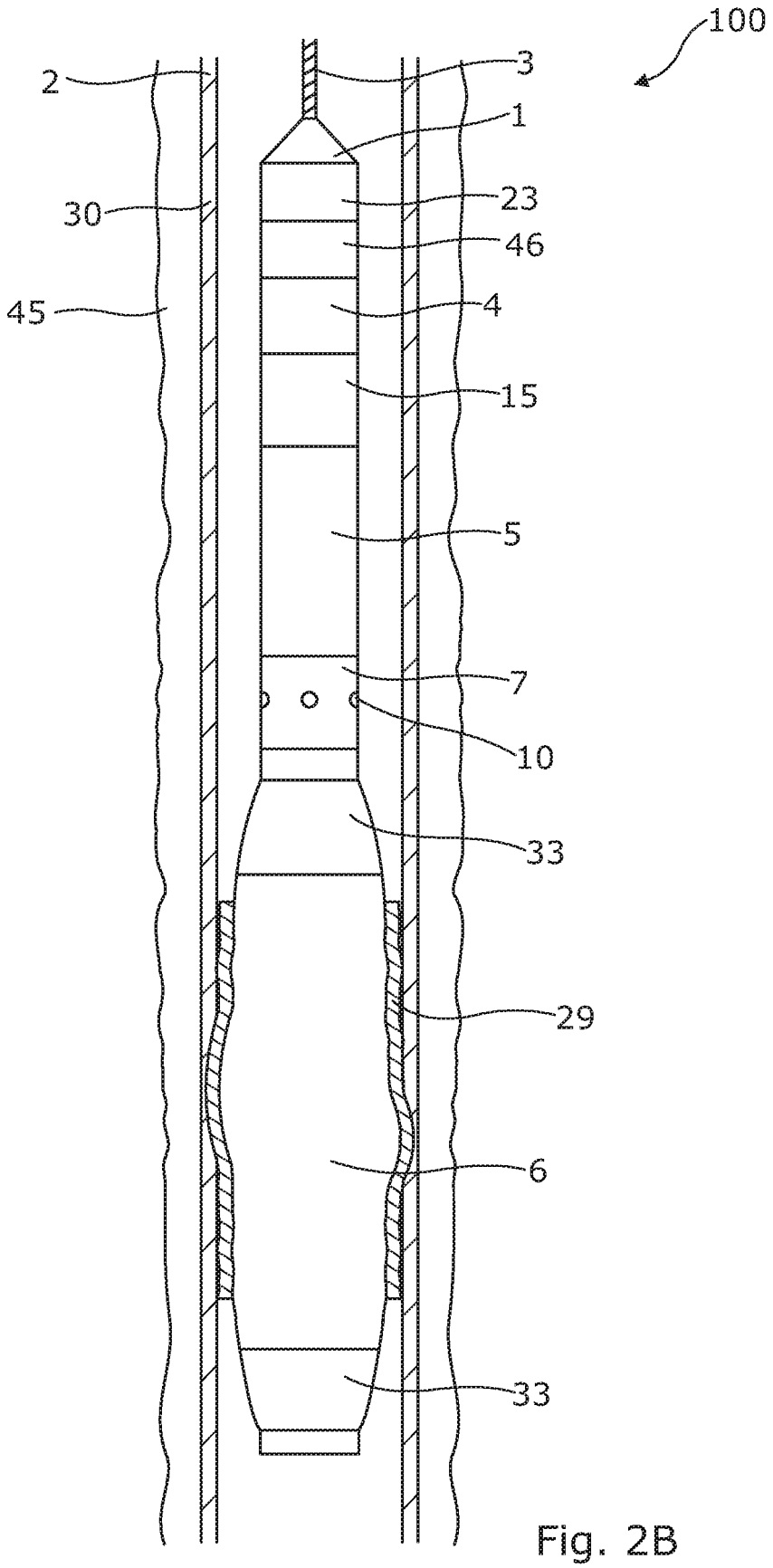
Figure 3:
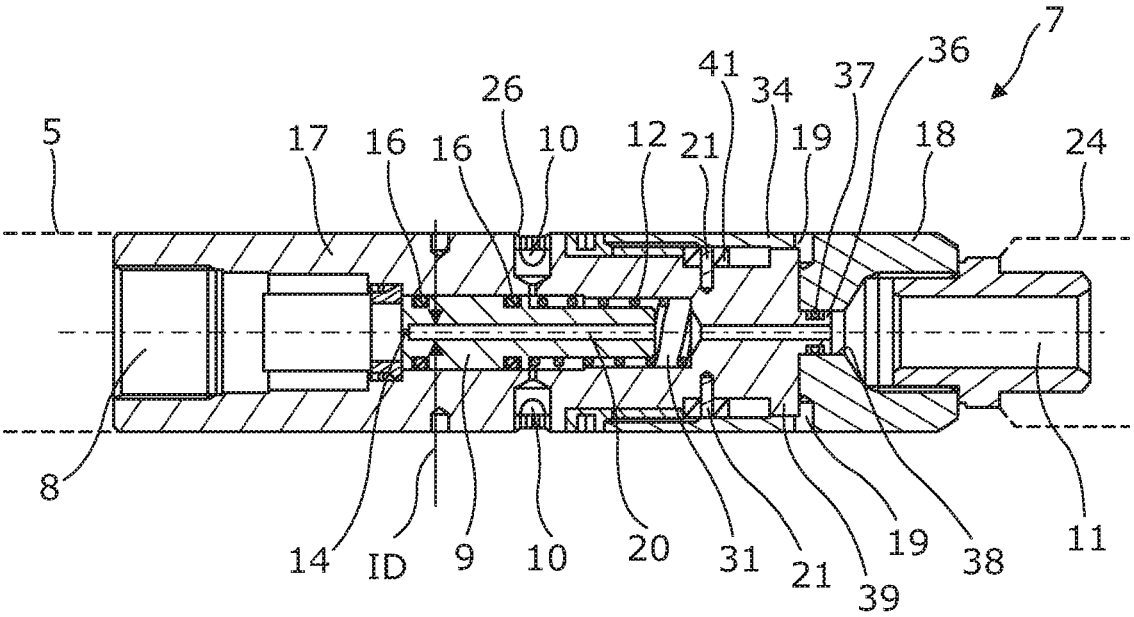
Figure 4:
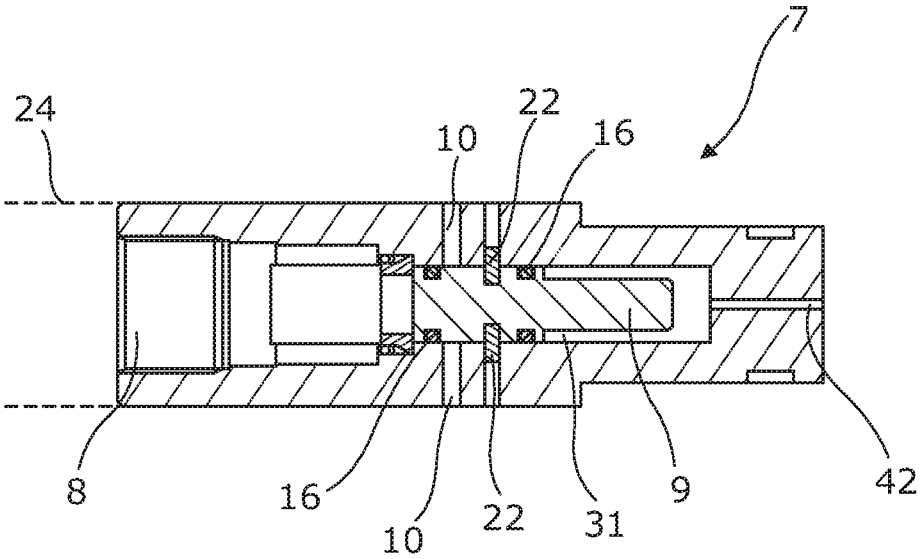
Figure 5:
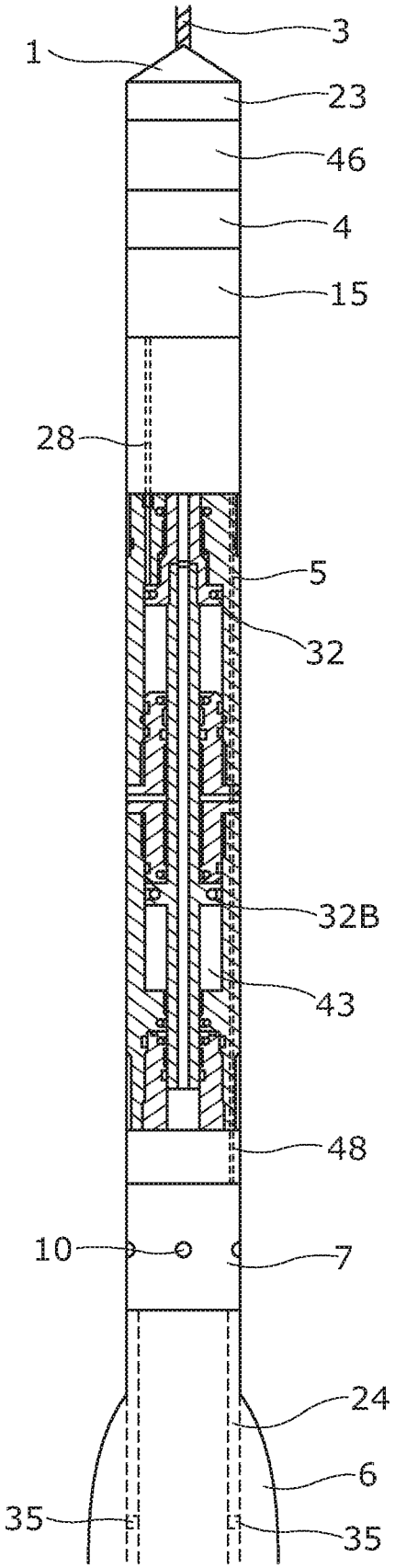
Figure 6:
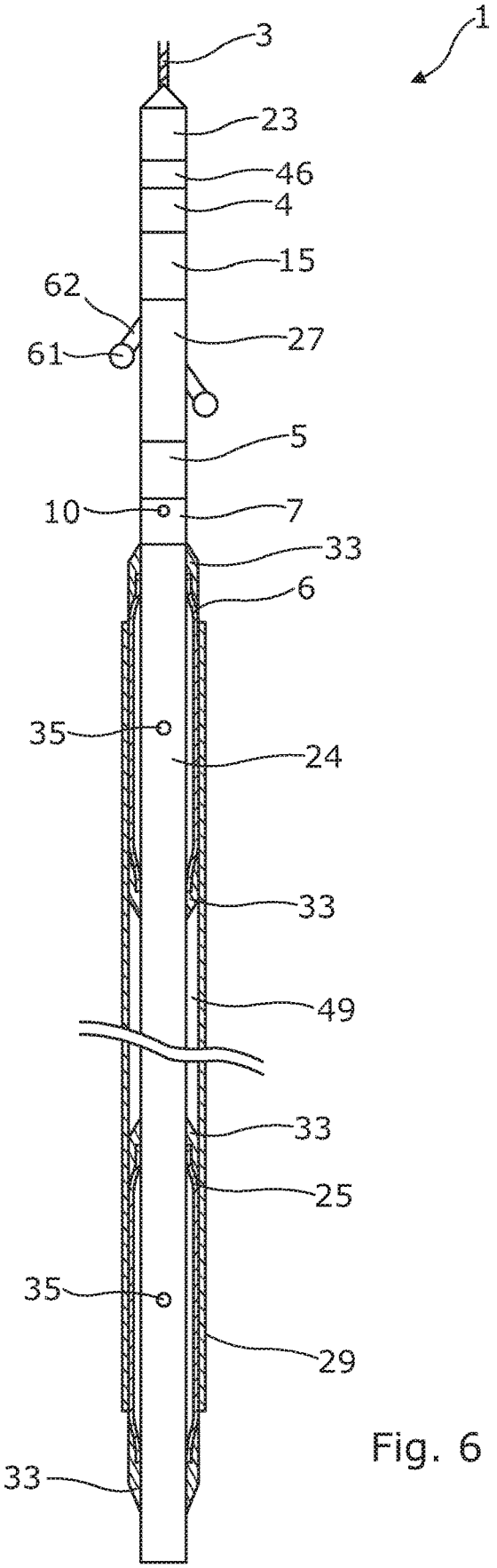

The invention and its many advantages will be described in more detail below with reference to the accompanying schematic drawings, which for the purpose of illustration show some non-limiting embodiments and in which:

FIG. 1A shows a downhole wireline intervention tool in an unexpanded condition in a well, FIG. 1B shows the downhole wireline intervention tool of FIG. 1A in an expanded condition where a bladder of the tool is expanded to make fractures in the surrounding formation, FIG. 2A shows a downhole wireline intervention tool before expanding a patch for sealing off a leak in the well tubular metal structure, FIG. 2B shows the downhole wireline intervention tool of FIG. 2A in an expanded condition where a bladder of the tool is expanded and expanding the patch to abut the well tubular metal structure and seal off the leak, FIG. 3 shows a cross-sectional view of a flow control device, FIG. 4 shows a cross-sectional view of another flow control device, FIG. 5 shows a partly cross-sectional view of another downhole wireline intervention tool, and FIG. 6 shows a partly cross-sectional of yet another downhole wireline intervention tool.

All the figures are highly schematic and not necessarily to scale, and they show only those parts which are necessary in order to elucidate the invention, other parts being omitted or merely suggested.

FIG. 1A shows a downhole wireline intervention tool 1 for performing intervention in a well 2, such as pressurising the formation for creating small fractures in a pre-fracturing process before performing a fracturing operation as illustrated in FIG. 1B. The downhole wireline intervention tool 1 comprises a wireline 3 powering a motor 4, a positive displacement pump 5 driven directly or indirectly by the motor 4 for delivering a flow of fluid to an expandable bladder 6, which is expanded by the fluid delivered by the positive displacement pump 5. The downhole wireline intervention tool 1 further comprises a flow control device 7, as shown in FIG. 3, which comprises an inlet 8, a piston 9, and a venting port 10 fluidly connected to the well. The piston is movable between a first position in which the venting port is fluidly connected to the expandable bladder and a second position in which the venting port is fluidly isolated from the expandable bladder 6 for expanding the expandable bladder.

It is possible to increase a pressure in the expandable bladder up to more than 300 bar, even with very little power, when having a positive displacement pump.

When operating in a well several kilometres from the well head or the blowout preventer, a lot of power is lost through the wireline, and therefore providing enough pressure to expand a patch or to pre-fracture the formation is impossible. Known patch setting tools are therefore operated with pressure from surface via a coiled tubing or a drill pipe in order to provide enough pressure. However, such coiled tubing equipment takes approximately 14 days to transport to an offshore well and therefore operation by wireline tools are preferred since these tools can be transported to the well by helicopter in a few hours. By having a flow control device, it is possible to use a positive displacement pump on a wireline and to provide the high pressure downhole, since the expanded expandable bladder can be deflated by moving the piston from the second position to the first position and then let fluid inside the bladder out into the well. A positive displacement pump can provide a high pressure but only in one direction, and it cannot return the fluid in the bladder without having to design a very complex positive displacement pump, and such complex pump is not small enough to enter into a well. When the fluid cannot be returned, the bladder cannot be deflated and hence not be retracted from the well. Therefore, by having the flow control device, the fluid inside the bladder is vented into the well in order to deflate the bladder in a simple manner and therefore, a positive displacement pump can be used in a wireline tool.

In FIG. 1A, the flow control device 7 is arranged downstream of the positive displacement pump 5 and downstream of the expandable bladder 6. The flow control device 7 is arranged at the bottom of the downhole wireline intervention tool 1 furthest away from the top of a well. In FIG. 1B, the positive displacement pump 5 is activated and the expandable bladder 6 is expanded by continuously letting fluid into the expandable bladder to make small fractures in the formation in order to control where the fractures are created in the subsequent fracturing process, e.g. by using pressurised frac fluid i.e. fracturing fluid. If the small fractures are not made, the fractures in the subsequent fracturing process are made where the formation is the weakest, which may not be where the fractures were intended to be. By making the pre-fractures with the expanded expandable bladder, the formation is pre-weakened at the locations where the fractures are intended to be arranged and in this way, the fractures can be positioned more accurately.

The pressure inside the expandable bladder of FIGS. 1A and 1B is vented through the venting port 10 in the flow control device 7. FIG. 4 shows a flow control device 7 suitable for being arranged in the bottom of the downhole wireline intervention tool. The flow control device 7 comprises a breakable element 22, such as a shear pin or a shear disc, arranged to fixate the piston 9 until a predetermined pressure is reached in the expandable bladder. In order to deflate the expandable bladder, the bladder is further pressurised after the operation of e.g. creating pre-fractures, expanding an annular barrier, or setting a patch, has ended, resulting in the breakable element 22 breaking and releasing of the piston 9. Then the piston 9 moves in a chamber 31 to the first position, providing fluid communication between the venting ports 10 and the expandable bladder 6 (shown in FIG. 1A). The fluid in the chamber 31 is pressed out of the port 42 when the piston 9 moves.

FIG. 2A shows the downhole wireline intervention tool 1 which comprises a patch 29, and which is arranged in a well tubular metal structure 30 in a wellbore/borehole 45 of a well 2. The downhole wireline intervention tool 1 is arranged so that the patch 29 is positioned opposite a leak or a weakening 46 in the well tubular metal structure 30. In FIG. 2B, the positive displacement pump 5 has been activated and the expandable bladder 6 is expanded, expanding the patch 29 until the patch abuts the well tubular metal structure 30 and conforms to the shape of the well tubular metal structure 30. The downhole wireline intervention tool 1 further comprises bladder connections 33 that fasten the expandable bladder 6 to a base pipe 24 (shown in FIG. 6). As can be seen in FIG. 2B, the bladder connections 33 are expandable towards the bladder 6, but they limit the free expansion of the ends of the bladder 6 in order to prevent the bladder from bulging unintentionally outwards.

In FIG. 2A, the flow control device 7 is arranged downstream of the positive displacement pump 5 and upstream of the expandable bladder 6. In this way, the inlet of the flow control device 7 is fluidly connected to the positive displacement pump, and an outlet 11 (shown in FIG. 3) of the flow control device is fluidly connected to the expandable bladder 6. The flow control device 7 is arranged between the expandable bladder 6 and the positive displacement pump 5 in order that fluid inside the expandable bladder 6 is returned to the venting port 10 in the flow control device 7 via the outlet 11 in order to deflate the expandable bladder 6. By having the flow control device 7 fluidly connected between the positive displacement pump 5 and the expandable bladder 6, the position of the flow control device 7 can be operated by the flow from the positive displacement pump 5 without having to rely on shear pins.

FIG. 3 shows a flow control device 7 for being arranged downstream of the positive displacement pump 5 and upstream of the expandable bladder. The piston of the flow control device 7 comprises a through-bore 20 fluidly connecting the inlet 8 and the outlet 11. The fluid flows from the positive displacement pump 5 through the through-bore 20 and into the expandable bladder via the base pipe 24. The through-bore 20 provides a restriction, creating a pressure drop on the downstream side of the piston 9, forcing the piston towards the expandable bladder and into the second position in which the venting port 10 is fluidly disconnected from the expandable bladder and the expandable bladder is expanded. When the positive displacement pump 5 stops displacing fluid into the bladder, the flow stops and the pressure across the piston 9 is equalised so that the piston 9 can return to the first position and the expandable bladder is drained from fluid through the venting port 10. The flow control device 7 comprises a chamber 31 in which the piston 9 is movable between the first position and the second position. The flow control device further comprises a spring 12 configured to force the piston 9 towards the inlet 8 and towards the first position. The flow of fluid, which creates the pressure difference across the piston, forces the piston towards the outlet and towards the second position. In FIG. 3, the piston 9 comprises a restriction 14 decreasing an inner diameter ID of the through-bore, creating a pressure drop over the piston. By having the restriction 14, the pressure difference across the piston during a flow through the through-bore is significantly larger than without the restriction 14.

In FIG. 3, the piston further comprises a first sealing element 16 and a second sealing element 16, which are arranged in such a manner that the first sealing element is arranged on one side of the venting port and the second sealing element is arranged on the other side of the venting port when they are in the second position, as shown in FIG. 4.

In FIG. 3, the flow control device 7 comprises a fail-safe release mechanism 34 in that the flow control device 7 comprises a first part 17 and a second part 18. The first part comprises the inlet 8, the venting port 10 and the piston 9, and the second part comprises the outlet 11 and a second venting port 19. The first part and the second part are fixated to each other by means of breakable parts 21, such as shear pins or shear discs, until a predetermined force is reached, and the breakable parts break and the first part is movable away from the second part in order to unblock a fluid communication between the second venting port and the expandable bladder. The fail-safe release mechanism 34 is used if the expandable bladder 6 is expanded and the piston 9 of the flow control device for some reason does not move to the first position. Then, the predetermined force for releasing the first part from the second part is reached by pulling in the downhole wireline intervention tool 1 and breaking the shear pins 21. Hereby, the first part 17 is moved away from fluidly isolating the second venting ports 19. The first part 17 has a protruding part 36 extending into a bore 38 of the second part 18. The protruding part 36 has surrounding seals 37 sealing against the bore 38. The first part 17 has a projecting flange 39 which, when pulling the downhole wireline intervention tool 1 to move the first part, engages a projection 41 of the second part 18 so that the first part and the second part are not fully disengaged when moving in relation to each other, so that the expandable bladder 6 is not disengaged from the remaining part of the tool. In this way, the expandable bladder can always be deflated and pulled out of the well. The venting ports 10, 19 may comprise a filter 26.

As shown in FIG. 5, the downhole wireline intervention tool 1 further comprises a hydraulic pump 15 driven by the motor for driving the positive displacement pump 5. The positive displacement pump 5 is thus indirectly driven by the motor through the hydraulic pump 15. The positive displacement pump is a reciprocating positive displacement pump, such as a piston pump. The positive displacement pump 5 comprises a reciprocating piston 32, and the hydraulic pump 15 drives the reciprocating piston 32 back and forth by providing fluid through hydraulic control lines 28 to each side of the reciprocating piston 32 which is controlled by a hydraulic block (not shown). The reciprocating piston 32 is connected to a second reciprocating piston 32B which pumps fluid into the bladder 6 via the base pipe 24. When the second reciprocating piston 32B moves in one direction, well fluid is sucked into a piston chamber 43 on the backside of the second reciprocating piston 32B in relation to the movement direction. Then, when the second reciprocating piston 32B is moved in the opposite direction, the newly sucked fluid is pushed out of the piston chamber 43 into the bladder through fluid channels (not shown) and via the base pipe 24 and the openings 35. When the second reciprocating piston 32B moves in the opposite direction again, fluid is sucked into the piston chamber 43 which is ready to be expelled into the bladder 6 when the second reciprocating piston 32B changes its moving direction. The downhole wireline intervention tool 1 further comprises a second hydraulic control line 48 which is fluidly connected to the hydraulic pump and the flow control device for moving the piston from the second position to the first position. The downhole wireline intervention tool 1 further comprises a control unit 23 for controlling the function of the tool, and a compensator 46 for compensating the pressure within the tool 1.

The expandable bladder 6 is arranged around a base pipe 24 and is expanded via openings 35 in the base pipe 24. The expandable bladder is made of a deflatable material, such as rubber, elastomer etc. and/or it may be made of a reinforced material.

The downhole wireline intervention tool 1 may further comprise a second expandable bladder 25 in order to expand a very long patch 29 as shown in FIG. 6. The two bladders 6, 25 are expanded, expanding the ends of the patch, and subsequently the space 49 created between the bladders 6, 25, the base pipe 24 and the patch are being pressurised thus expanding the middle part of the patch 29.

In another embodiment, the two bladders shown in FIG. 6, but without the patch, may be expanded in a well tubular metal structure opposite an expansion opening therein and pressurise the space between the bladders and the well tubular metal structure in order to pressurise an expandable metal sleeve of an annular barrier through the expansion opening. The downhole wireline intervention tool having two expandable bladders may also be used to clean a screen by pressurising the space between the expanded bladders and the well tubular metal structure opposite the opening to the screen.

As can be seen in FIG. 6, the downhole wireline intervention tool 1 further comprises a driving unit 27, such as a downhole tractor, having wheels 61 and projectable arms 62.

In FIG. 2A, the downhole wireline intervention tool 1 is part of a downhole system 100, which comprises a well tubular metal structure 30 arranged at least partly in a borehole 45 of a well 2 and further comprises a patch 29 configured to be expanded by the expandable bladder at a certain position in the well, as shown in FIG. 2B.

The invention further relates to an intervention method by intervening a well by means of the downhole wireline intervention tool 1, positioning the downhole wireline intervention tool at a certain position in the well, activating the positive displacement pump for delivering a flow of fluid into the expandable bladder which is expanded when the piston of the flow control device is in the second position. Then, the piston of the flow control device is moved from the second position to the first position, and the expandable bladder is deflated this activation of the flow control device. The moving of the piston of the flow control device from the second position to the first position is performed by breaking a breakable element when reaching a predetermined pressure difference, releasing the piston, or by stopping the flow of fluid from the positive displacement pump, thereby equalising the pressure so that the piston is free to move.

By fluid or well fluid is meant any kind of fluid that may be present in oil or gas wells downhole, such as natural gas, oil, oil mud, crude oil, water etc. By gas is meant any kind of gas composition present in a well, completion, or open hole, and by oil is meant any kind of oil composition, such as crude oil, an oil-containing fluid etc. Gas, oil, and water fluids may thus all comprise other elements or substances than gas, oil, and/or water, respectively.

By an annular barrier is meant an annular barrier comprising a tubular metal part mounted as part of the well tubular metal structure and an expandable metal sleeve surrounding and connected to the tubular part defining an annular barrier space.

By a casing or well tubular metal structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole wireline intervention tool for performing intervention in a well, comprising:

a wireline, a downhole motor powered by the wireline, a hydraulic pump driven by the motor, a downhole positive displacement pump driven by the hydraulic pump for delivering a flow of fluid, an expandable bladder expanded by fluid delivered by the positive displacement pump, a flow control device comprising an inlet, a piston and a venting port fluidly connected to the well, the piston being movable between a first position in which the venting port is fluidly connected to the expandable bladder to deflate the bladder and a second position in which the venting port is fluidly isolated from the expandable bladder for expanding the expandable bladder.

2. The downhole wireline intervention tool according to claim 1, wherein the flow control device is arranged downstream of the positive displacement pump and upstream of the expandable bladder in order that the inlet is fluidly connected to the positive displacement pump and an outlet is fluidly connected to the expandable bladder.

3. The downhole wireline intervention tool according to claim 2, wherein the piston comprises a through-bore fluidly connecting the inlet and the outlet.

4. The downhole wireline intervention tool according to claim 1, wherein the flow control device further comprises a spring configured to force the piston towards the inlet.

5. The downhole wireline intervention tool according to claim 2, wherein the flow control device comprises a first part and a second part, the first part comprising the inlet, the venting port and the piston, and the second part comprising the outlet and a second venting port, the first part and the second part being fixated to each other by means of breakable parts, such as shear pins or shear discs, until a predetermined force is reached and the breakable parts break and the first part is movable away from the second part in order to unblock a fluid communication between the second venting port and the expandable bladder.

6. The downhole wireline intervention tool according to claim 2, wherein the flow control device further comprises a housing, and wherein the inlet and the outlet are disposed on opposite ends of the housing and the venting port is disposed between the inlet and the outlet.

7. The downhole wireline intervention tool according to claim 1, wherein the flow control device is arranged between the expandable bladder and the positive displacement pump.

8. The downhole wireline intervention tool according to claim 3, wherein the piston comprises a restriction decreasing an inner diameter of the through-bore, creating a pressure drop over the piston.

9. The downhole wireline intervention tool according to claim 1, wherein the piston comprises a first sealing element and a second sealing element which in the second position of the piston are arranged in such a manner that the first sealing element is arranged on one side of the venting port and the second sealing element is arranged on the other side of the venting port.

10. The downhole wireline intervention tool according to claim 1, wherein the flow control device comprises a breakable element, arranged for fixating the piston until a predetermined pressure is reached in the expandable bladder.

11. The downhole wireline intervention tool according to claim 10, wherein the breakable element comprises a shear pin or a shear disc.

12. The downhole wireline intervention tool according to claim 10, wherein the inlet is oriented in an axial direction of the tool and the venting port is oriented in another direction that is transverse to the axial direction.

13. The downhole wireline intervention tool according to claim 12, wherein the inlet and the venting port are positioned on a part having a one piece construction.

14. The downhole wireline intervention tool according to claim 1, further comprising a second expandable bladder.

15. The downhole wireline intervention tool according to claim 1, wherein the positive displacement pump is configured to produce fluid flow in only one direction, towards the bladder via the inlet, and the pump is not configured to remove fluid from the bladder.

16. A downhole system comprising a well tubular metal structure arranged at least partly in a borehole of a well and further comprising the downhole wireline intervention tool according to claim 1.

17. The downhole system according to claim 16, further comprising a patch configured to be expanded by the expandable bladder at a certain position in the well.

18. An intervention method for intervening in a well by means of the downhole wireline intervention tool according to claim 1, comprising:

performing intervention in the well by means of the downhole wireline intervention tool, positioning the downhole wireline intervention tool at a certain position in the well, activating the positive displacement pump for delivering a flow of fluid into the expandable bladder, expanding the expandable bladder when the piston of the flow control device is in the second position, moving the piston of the flow control device from the second position to the first position, and deflating the expandable bladder by activating the flow control device thereby allowing fluid inside the bladder to exhaust through the venting port.

19. The intervention method according to claim 18, wherein the moving of the piston of the flow control device from the first position to the second position is performed by breaking a breakable element when reaching a predetermined pressure difference, releasing the piston, or by stopping the flow of fluid from the positive displacement pump equalising the pressure in order that the piston is free to move.

* * * * *